US007056099B1

(12) United States Patent
Lucas

(10) Patent No.: US 7,056,099 B1
(45) Date of Patent: Jun. 6, 2006

(54) TIRE PRESSURE MAINTENANCE UNIT

(76) Inventor: Tim Lucas, 134 Hamilton Dr., Mount Gilead, NC (US) 27306-9344

( * ) Notice: Subject to any disclaimer, the term of this patent is extended or adjusted under 35 U.S.C. 154(b) by 419 days.

(21) Appl. No.: 10/644,637

(22) Filed: Aug. 21, 2003

(51) Int. Cl.
*F04B 53/00* (2006.01)

(52) U.S. Cl. ..... 417/234; 239/441; 239/26

(58) Field of Classification Search ..... 417/234; 239/26, 441
See application file for complete search history.

(56) References Cited

U.S. PATENT DOCUMENTS

| | | | | |
|---|---|---|---|---|
| 2,445,959 | A | | 7/1948 | Luper |
| 3,241,112 | A | | 3/1966 | Linkmeyer |
| 3,268,678 | A | | 8/1966 | James |
| 3,462,735 | A | | 8/1969 | Hawes |
| 4,054,163 | A | | 10/1977 | Brown, Jr. et al. |
| 4,489,855 | A | | 12/1984 | Boetger |
| 4,621,984 | A | * | 11/1986 | Fussell ..... 417/234 |
| 5,025,244 | A | | 6/1991 | Huang |
| 5,124,395 | A | | 6/1992 | Abramowski et al. |
| 5,407,330 | A | * | 4/1995 | Rimington et al. ..... 417/312 |
| 5,967,198 | A | * | 10/1999 | Smalley ..... 141/38 |

FOREIGN PATENT DOCUMENTS

| | | |
|---|---|---|
| GB | 1153900 | 5/1969 |

* cited by examiner

*Primary Examiner*—Charles G. Freay
*Assistant Examiner*—Ryan Gillan
(74) *Attorney, Agent, or Firm*—Donald R. Schoonover

(57) ABSTRACT

A portable and hand-held unit is used to pump air into vehicle tires to a pre-set pressure and to remind a vehicle owner to monitor the pressure of the tires on the vehicle. The unit includes a light, a power source, an air pump, and a one-way valve and is used by connecting an outlet valve to an inflation valve on a vehicle tire via a special adapter.

7 Claims, 2 Drawing Sheets

TIRE PRESSURE MAINTENANCE UNIT

BACKGROUND OF THE INVENTION

1. Field of the Invention

The present invention relates to the general art of vehicle tires, and to the particular field of accessories for vehicle tires.

2. Discussion of the Related Art the dangers of mis-inflated automobile tires are well documented. Mis-inflated automobile tires are not only dangerous, they can be wasteful of fuel and may adversely affect the wear of the tire.

Manufactures, both vehicle manufacturers and tire manufacturers, generally publish recommended tire pressures. It is up to the vehicle operator to be sure that the tires of the vehicle are inflated to the recommended pressures.

Since tire pressures change according to driving conditions, it is unwise, or at worst dangerous, to ignore tire pressure. Manufacturers generally recommend that tire pressure be checked periodically, and before, during and after unusual driving conditions are encountered.

Checking tire pressure generally requires a person to pull into a station that dispenses air for tires, remove a valve stem cover, apply a pressure gauge to the tire to take a pressure reading, remove the gauge, connect an air hose to the tire, pump air into the tire, remove the air hose, re-connect the pressure gauge to the tire to be sure the tire air pressure is proper, and repeat this process until the tire air pressure is proper, then repeat the process for each tire of the vehicle. Even if the air dispenser includes a system that shuts off when a pre-set pressure is reached, in order to be accurate, the tire pressure should be checked with a gauge.

This procedure is time consuming, onerous and inconvenient. Accordingly, many people simply ignore the pressure of the tires of their vehicle, and/or wait for a general vehicle service which will check the tires as part of the overall service. As discussed above, failing to properly monitor tire pressure is undesirable.

Therefore, there is a need for a device that can quickly, efficiently and easily maintain vehicle tire pressure.

There is a further need for a device that can remind a vehicle owner to check the pressure of the vehicle tires.

One problem encountered by many people is the paucity of air dispensing stations. Thus, even if a vehicle owner desires to maintain proper vehicle tire pressure, it is often difficult for that owner to find a station that dispenses air. Still further, some stations charge for air used for vehicle tires. Both of these situations mitigate against proper tire maintenance, even when a vehicle owner desires to effect proper tire maintenance.

Therefore, there is a need for a device that can maintain vehicle tires at a desired inflation pressure and which is readily available to a vehicle owner when and where it is needed.

A further problem which exacerbates many of the above-mentioned problems is created by the design of presently-available tire inflation systems. These systems are often set up for right-handed individuals. A left-handed individual may find it somewhat cumbersome to use many presently-available systems. This may further discourage that person from properly maintaining the tire pressure of the tires of his or her vehicle.

Therefore, there is a need for a device that can maintain vehicle tires at a desired inflation pressure and which is readily usable by either a right-handed individual or a left-handed individual.

Some vehicle owners do not feel they always have the time to check the inflation pressure of the tires on their vehicle when they stop at a service station during a workday. Thus, these owners often forego checking tire pressure until another visit, which often is also considered inconvenient. Because of this, many tires are not properly monitored.

However, some vehicle owners may feel they have the time to check tire pressure on the way home form work or at night when they do not feel the press of time which is felt during the workday. This presents a drawback because many air dispensing stations are located in low light areas. This will make it difficult to see the tire valve and read the air pressure gauge.

Therefore, there is a need for a device that can maintain vehicle tires at a desired inflation pressure and which is readily usable under low light conditions.

PRINCIPAL OBJECTS OF THE INVENTION

It is a main object of the present invention to provide a device that can quickly, efficiently and easily maintain vehicle tire pressure.

It is another object of the present invention to provide a device that can remind a vehicle owner to check the pressure of the vehicle tires.

It is another object of the present invention to provide a device that can maintain vehicle tires at a desired inflation pressure and which is readily available to a vehicle owner when and where it is needed.

It is another object of the present invention to provide a device that can maintain vehicle tires at a desired inflation pressure and which is readily usable by either a right-handed individual or a left-handed individual.

It is another object of the present invention to provide a device that can maintain vehicle tires at a desired inflation pressure and which is readily usable under low light conditions.

SUMMARY OF THE INVENTION

These, and other, objects are achieved by a hand-holdable unit adapted to pump air into a tire of a vehicle which comprises a housing unit having a handle and an air-dispensing opening defined therein; an air-dispensing nozzle unit on the housing unit and which includes a front plate on said housing unit, a nozzle housing mounted on the front plate and having an inlet end in fluid communication with the air-dispensing opening on the housing unit and an outlet end in fluid communication with the inlet end of the nozzle housing, a wishbone actuator element in the nozzle unit and movable between a first position and a second position and which includes a body which is located adjacent to the outlet end of the nozzle housing, a first leg connected to the body and extending into the housing unit, a second leg connected to the body, and a spring element mounted on the wishbone actuator element in a manner which biases the wishbone actuator element toward the first position; an adapter element which is sized and adapted to be received in the nozzle unit adjacent to the outlet end of the nozzle unit and which is adapted to be in fluid communication with a valve on a tire of a vehicle; an air control unit which includes a power source in the housing unit, a control circuit in the housing unit and which includes an internal memory and an internal power supply, a push button on/off control button on the housing unit and positioned to be engaged by the first leg of the wishbone actuator element when the wishbone actuator element is in the second position, the push button on/off control button electrically connecting the control circuit to the power source when the push button on/off control button is in an "on" condition, the push button on/off control button being placed in the "on" condition when engaged by the first leg of the wishbone actuator element, and an air flow control circuit on the housing unit and which includes a fluid pump electrically connected to the control circuit to be activated by the control circuit, a control valve that is electrically connected to the control circuit and which moves between a fluid flow position and a fluid-blocking position and which includes a biasing element that biases the control valve toward the fluid-blocking position, the control valve further including an element that is electrically connected to the control circuit and which moves the control valve against the bias of the biasing element toward the fluid flow position when activated by the control circuit when the control circuit is connected to the power source by the push button on/off control button, a one-way valve fluidically interposed between the control valve and the outlet end of the nozzle housing and oriented to permit fluid flow toward the outlet end of the nozzle housing and to prevent fluid flow from the outlet end of the nozzle housing toward the control valve, a pressure sensor in the one-way valve and which is electrically connected to the control circuit to activate the control circuit to disconnect the pump from the power source when a pre-set pressure is sensed in the one-way valve by the pressure sensor, and the fluid connection between the one-way valve and the control valve and the pump and the outlet end of the nozzle housing permitting flow of fluid from the fluid pump to the outlet end of the nozzle housing and via the outlet end of the nozzle housing to a tire valve of a vehicle tire and via the tire valve to the tire when the fluid pump is actuated by the wishbone actuator via the control circuit when fluid pressure in the one-way valve is below the pre-set pressure; and a light circuit on said housing unit, the light circuit including a light on the housing unit and a switch on the handle which electrically connects the light on the housing unit to the power source when the switch on the handle is in an "on" position.

The device embodying the present invention thus is readily available whenever it is needed, is easy to use by all and is accurate. The device can be used to remind a vehicle owner to check tire pressure and can be used in low light conditions thereby further encouraging a vehicle owner to monitor tire pressure.

BRIEF DESCRIPTION OF THE DRAWING FIGURES

DETAILED DESCRIPTION OF THE PREFERRED EMBODIMENT

Figure 1:
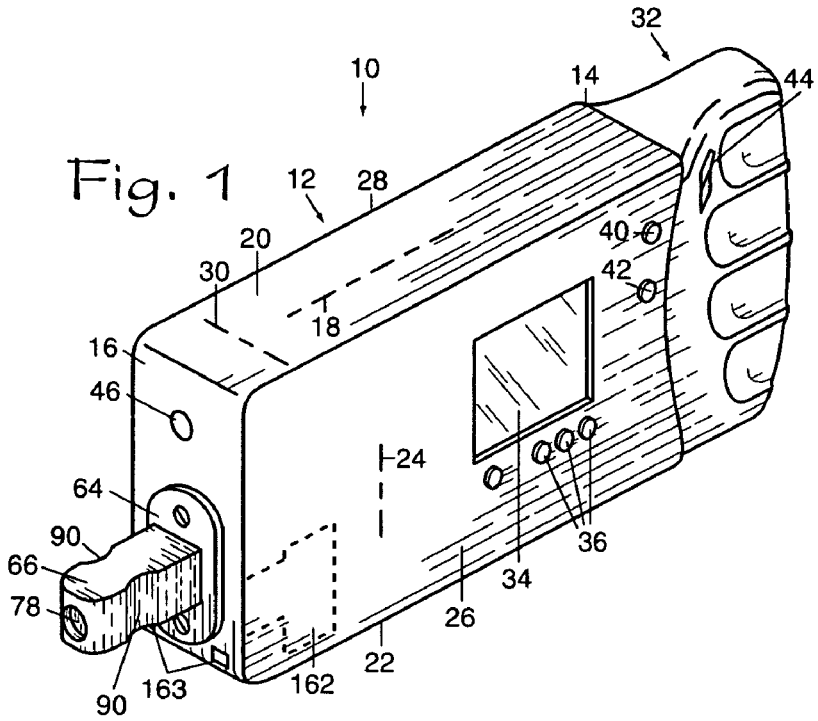
FIG. 1 is a perspective view of the device embodying the present invention.
Figure 2:
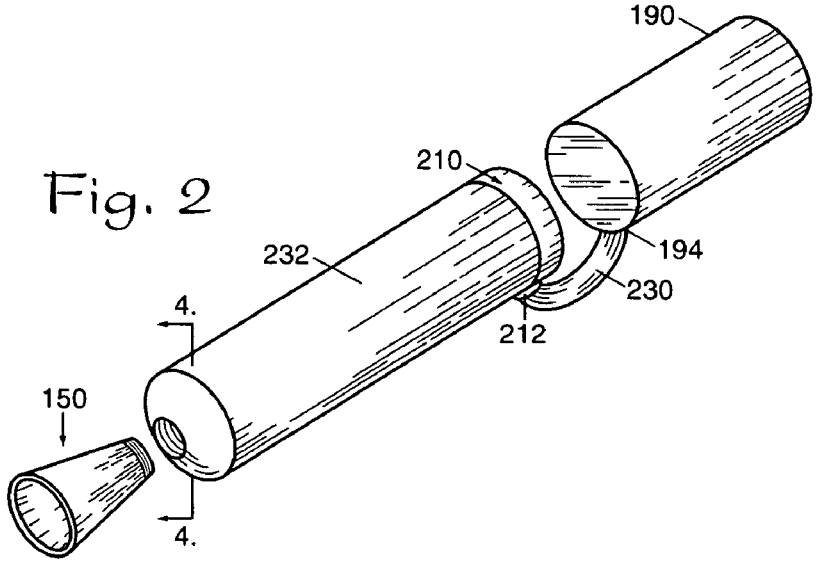
FIG. 2 is a perspective view of a fluid pump and fluid flow cylinder used in the device of the present invention.

Other objects, features and advantages of the invention will become apparent from a consideration of the following detailed description and the accompanying drawings.

Referring to the figures, it can be understood that the present invention is embodied in a hand-holdable unit 10 which is adapted to pump air into vehicle tires. Device 10 comprises a housing unit 12 which has a first end 14, a second end 16, and a longitudinal axis 18 extending between the first end 14 and the second end 16 of the housing unit 12. The housing 12 further includes a first side wall 20, a second side wall 22, and a transverse axis 24 extending between the first side wall 20 and the second side wall 22 of the housing unit 12. The housing unit 12 further includes a first side surface 26, a second side surface 28, and a thickness 30 extending between the first side surface 26 and the second side surface 28 of the housing unit 12.

A handle 32 is on the first end 14 of the housing unit 12, and a display window 34 is on the first side surface 66. A plurality of control buttons 36 are located on the first side surface 26, and include pressure setting controls, reminder time setting controls, pressure cutoff controls and the like as will occur to those skilled in the art based on the teaching of this disclosure.

A plurality of indicator lights 40 and 42 are on the first side surface 26, and include a green "go" light, a red "stop" light and the like. The red light can also be used as a reminder light and will glow after a preset time period to remind a vehicle owner to check the air pressure in the tires of his or her vehicle. The lights will be controlled in accordance with settings made using the control buttons 36. Operation of the lights will be understood from the teaching of the following disclosure.

An on/off button 44 is located on the handle 32, and is used to actuate a light 46 on the second end 16 of the housing 12 so the device 10 can be used in low light conditions as will be understood from the following disclosure.

The housing unit 12 includes a hollow interior 50 as well as an air-dispensing opening 52 defined through the second end 16 of the housing unit 12. A first operating opening 54 is defined through the second end 16 of the housing unit 12 adjacent to the air-dispensing opening 51, and a second operating opening 56 is defined through the second end 16 of the housing unit 12 adjacent to the air-dispensing opening 51.

An air-dispensing nozzle unit 60 is located on the second end 16 of the housing unit 12. Air-dispensing unit 60 includes an O-ring seal 62 located adjacent to the air-dispensing opening 51, and a front plate 64 located adjacent to the O-ring seal 62. The front plate 64 includes a first actuator element leg-accommodating hole 66 located to be adjacent to and aligned with the first operating opening 54 defined through the second end 16 of the housing unit 12 and a second actuator element leg-accommodating hole 68 located to be adjacent to and aligned with the second operating opening 56 defined through the second end 16 of the housing unit 12. Fasteners, such as screw 70, attach the front plate 64 to the second end 16 of the housing unit 12.

A nozzle housing 74 is mounted on the front plate 64 and has a dispensing end 76. The dispensing end 76 of the nozzle housing 74 has an air-dispensing opening 78 defined therethrough. A flexible cover 80 can be used to cover the air-dispensing opening 78 if desired.

An inlet end 82 of the nozzle housing 74 is located adjacent to and in fluid communication with the air-dispensing opening 78 defined through the second end 16 of the housing unit 12. A longitudinal axis 84 extends between the dispensing end 76 of the nozzle housing 74 and the inlet end 82 of the nozzle housing 74 and is co-linear with the longitudinal axis 18 of the housing unit 12 when the air-dispensing nozzle unit 60 is in place on the housing unit 12.

An air-dispensing passage 86 is defined in the nozzle housing 74 and fluidically connects the air-dispensing opening 78 in the dispensing end 76 of the nozzle housing 74 to the inlet end 82 of the nozzle housing 74.

Knurling grooves 90 are on the nozzle housing 74 and permit the device 10 to be used by either a right-handed individual or a left-handed individual.

A spider support frame element 92 is mounted on the nozzle housing 74 in the air-dispensing passage 86 adjacent to the dispensing end 76 of the nozzle housing 74. The spider support frame 92 includes a hole 94 defined therethrough and which is centered on the longitudinal axis 84 of the nozzle housing 74. The hole 94 defined through the spider support frame 92 is fluidically connected to the air-dispensing passage 86 defined in the nozzle housing 74.

A wishbone actuator element 100 is movably located inside the nozzle housing 74. The wishbone actuator element 100 has a body 102 which is located on the longitudinal axis 84 of the nozzle housing 74 and which extends through the hole 94 defined through the spider support element 92 and is located adjacent to the air-dispensing passage 86 and adjacent to the air-dispensing opening 78 defined in the dispensing end 76 of the nozzle housing 74. The body 102 of the wishbone actuator element 100 includes a forward end 104 and a rear end 106.

A first leg 108 of the wishbone actuator element 100 has a first end 110 attached to the rear end 106 of the body 102 of the wishbone actuator element 100 and a second end 112 which extends through the first actuator element leg accommodating hole 66 in the front plate 64 and through the first operating opening 54 defined through the second end 16 of the housing unit 12.

Figure 3:
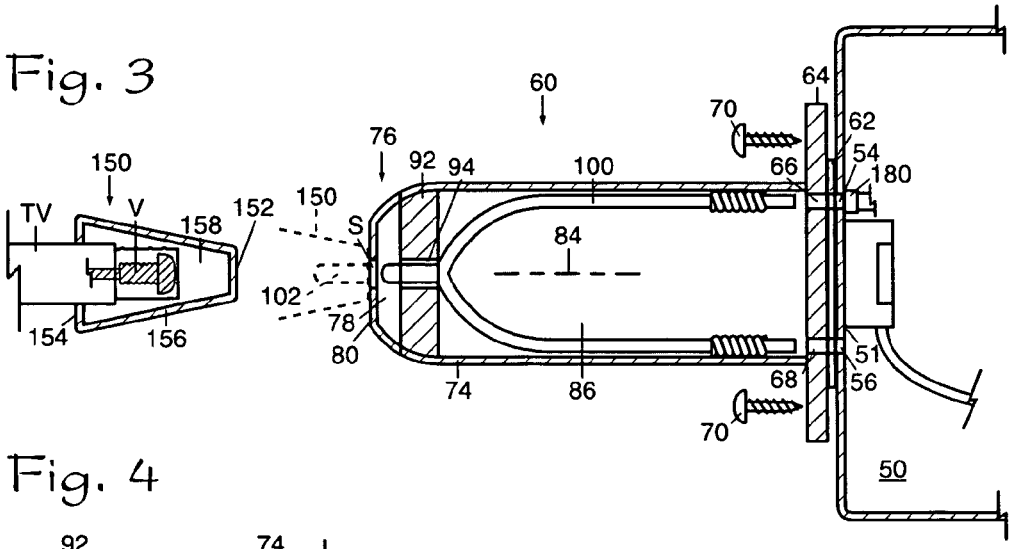
FIG. 3 shows a nozzle unit in combination with an adapter element used to attach the device of the present invention to a valve of a tire of a vehicle in accordance with the teaching of the present invention.
Figure 4:
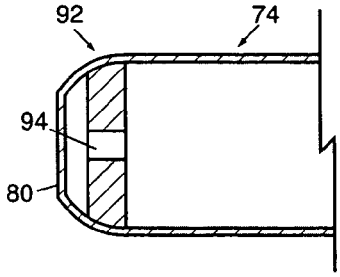
FIG. 4 is a view of the nozzle unit taken along line 4—4 of FIG. 1.
Figure 5:
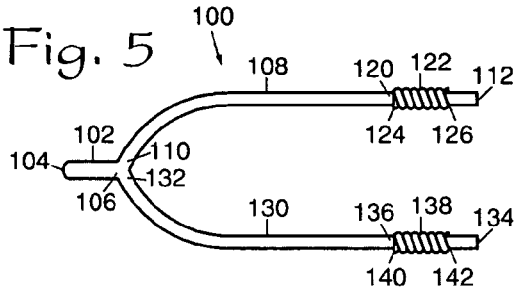
FIG. 5 shows a wishbone actuator element used in the device embodying the present invention.

The wishbone actuator element 100 moves in the nozzle housing 74 between a first position, indicated in FIG. 3 in dotted lines, with the forward end 104 of the body 102 extending out of the air-dispensing opening 78 in the dispensing end 76 of the nozzle housing 74 and in a position that is adapted to engage and operate a valve-opening element V of a tire valve TV of a tire of a vehicle and a second position, shown in solid lines in FIG. 3, having the forward end 104 of the body 102 located adjacent to the spider support element 92. The second end 112 of the first leg 108 of the wishbone actuator element 100 is located inside the housing unit 12 when the wishbone actuator element 100 is in the second position.

A first spring abutment 120 is on the first leg 108 of the wishbone actuator element 100 adjacent to the second end 112 of the first leg 108, and a first spring 122 is on the first leg 108 of the wishbone actuator element 100. The first spring 122 has a first end 124 abutting the first spring abutment 120 and a second end 126 abutting the front plate 64. The first spring 122 biases the wishbone actuator element 100 toward the first position.

A second leg 130 of the wishbone actuator element 100 has a first end 132 attached to the rear end 106 of the body 102 of the wishbone actuator element 100 and a second end 134 which extends through the second actuator element leg-accommodating hole 68 in the front plate 64 and through the second operating opening 56 defined through the second end 16 of the housing unit 12. A second spring abutment 136 is on the second leg 130 of the wishbone actuator element 100 adjacent to the second end 134 of the second leg 130, and a second spring 138 is located on the second leg 130 of the wishbone actuator element 100. The second spring 138 has a first end 140 abutting the second spring abutment 136 and a second end 142 abutting the front plate 64. The second spring 138 biases the wishbone actuator element 100 toward the first position.

A tapered adapter element 150 is structured to be accommodated through the air-dispensing opening 78 in the dispensing end 76 of the nozzle housing 74. Flexible cover 80 can have a suitable slit S defined therein to accommodate adapter element 150. The adapter element 150 has a first end 152 which is smaller than the air-dispensing opening 78 and a second end 154 that is larger than the air-dispensing opening 78. Adapter element 150 is structured to move between a first position (shown in dotted lines in FIG. 3) relative to the nozzle housing 74 with the first end 152 of the adapter element 150 located inside the nozzle housing 74 and a second position (shown in solid lines in FIG. 3) relative to the nozzle housing 74 in which the adapter element 150 is located outside the nozzle housing 74. The adapter element 150 further includes a side wall 156 which connects the first end 152 of the adapter element 150 to the second end 154 of the adapter element 150. The side wall 156 of the adapter element 150 is in fluid-occluding contact with the nozzle housing 74 adjacent to the air-dispensing opening 78 of the nozzle housing 74 when the adapter element 150 is in the first position thereof. The adapter element 150 further includes an air passage 158 fluidically connecting the first end 152 of the adapter element 150 to the second end 154 of the adapter element 150. The air passage 158 of the adapter element 150 is fluidically connected to the air-dispensing passage 86 in the nozzle unit 60 when the adapter element 150 is in the first position thereof. The second end 154 of the adapter element 150 is structured to accommodate the valve on the tire of an automotive vehicle and to place the air passage 158 of the adapter element 150 in fluid communication with the inside of the tire to place the interior of the tire in fluid communication with the air-dispensing passage 86 of the nozzle unit 60 when the adapter element 150 is in the first position and the wishbone actuator element 100 is in the first position thereof.

An air control unit 160 is fluidically connected to the air-dispensing passage 86 of the nozzle unit 60. The air control unit 160 includes a power source 162 in the housing unit 12. The power source 162 can be a rechargeable battery or the like. If a rechargeable battery is used, recharging contacts 163 are located on the outside of the housing unit 12.

A control circuit 164 located in the housing unit 12 includes an internal memory 166 and an internal power source 168. The internal memory 166 is used to store information, such as reminder information for the owner of the vehicle to check tire pressure, and the like, and will actuate one of the lights 40 or 42 when it is time to check tire pressure.

A display unit 170 is located in the housing unit 12 adjacent to the display window 34 of the housing unit 12. The display unit 170 is electrically connected to the control circuit 164 to be activated by the control circuit 164 to indicate operations being performed by the control circuit 164 in the display window 34. Operation of the device 10 can be set and controlled using the control buttons 36 and the display in the display window 34.

The control buttons 36 on the housing unit 12 are electrically connected to the control circuit 164 to control operations of the control circuit 164 according to settings associated with the control buttons 36.

The indicator lights on the housing unit 12 are electrically connected to the control unit 160 to be activated according to operations being performed by the control circuit 164.

A push button on/off control button 180 is on the second end 16 of the housing unit 12 adjacent to the first actuator element leg-accommodating hole 66 in the front plate 64 and adjacent to the first operating opening 54 defined through the second end 16 of the housing unit 12. The push button on/off control button 180 is located to be abuttingly engaged by the second end 112 of the first leg 108 of the wishbone actuator element 100 when the wishbone actuator element 100 is in the second position thereof. The push button on/off control button 180 moves between an "on" condition (shown in dotted lines in FIG. 6) when the second end 112 of the first leg 108 of the wishbone actuator element 100 is in abutting contact with the on/off control button 180 and an "off" condition (shown in solid lines in FIG. 6) when the second end 112 of the first leg 108 of the wishbone actuator element 100 is spaced apart from the on/off control button 180. The on/off control button 180 electrically connects the power source to the control circuit 164 when the on/off control button 180 is in the "on" condition.

An air flow control fluid circuit 190 is on the housing unit 12 and includes a fluid pump 192 in the housing unit 12. The fluid pump 192 is electrically connected to the control circuit 164 to be electrically connected to the power source via the control circuit 164 and to be activated according to control of the control circuit 164. The fluid pump 192 includes an air outlet 194 located inside the housing unit 12.

Figure 6:
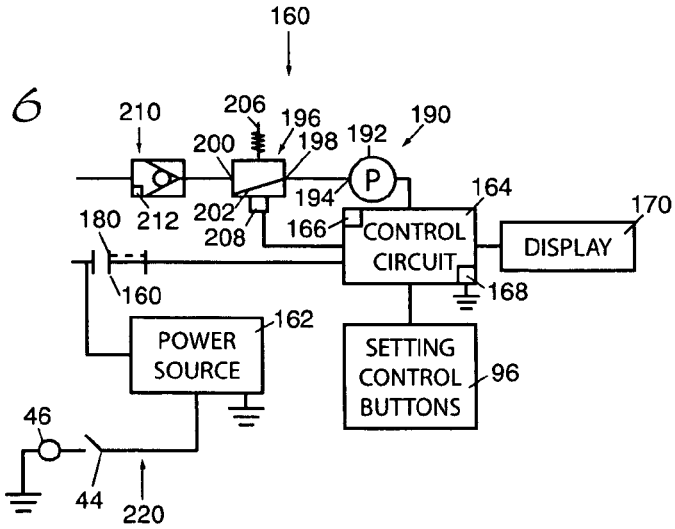
FIG. 6 is a schematic representation of a fluid system used in the device embodying the present invention.

A control valve 196 includes an air inlet 198 fluidically connected to the air outlet 194 of the fluid pump 192 and an air outlet 200. A control valve element 202 that moves between a fluid passage position fluidically connecting the air outlet 200 of the control valve 196 to the air inlet 198 of the control valve 196 and a fluid-occluding position (as shown in FIG. 6) in which the control valve element is in a position preventing fluid communication between the air inlet 198 of the control valve 196 and the air outlet 200 of the fluid control valve 196. The control valve 196 further includes a spring element 206 which biases the control valve element 202 toward the fluid-occluding position and a control valve element-moving unit 208 electrically connected to the control circuit 164 to be controlled thereby and connected to the control valve element 202 to move the control valve element 202 against the bias of the spring element 206 into the fluid passage position when activated by the control circuit 164.

A one-way valve 210 is fluidically interposed between the control valve 196 and the air-dispensing passage 86 of the nozzle unit 74 and is positioned to prevent fluid flow from the air-dispensing passage 86 of the nozzle unit 74 toward the control valve 196 and to permit fluid flow from the control valve 196 towards the air-dispensing passage 86 of the nozzle unit 74. The one-way valve 210 including a pressure sensor 212 that is electrically connected to the control circuit 164 to activate the control circuit 164 to stop operation of the fluid pump 192 when fluid pressure in the one-way valve 210 reaches a pressure level that has been set using one of the control buttons 36.

A light circuit 220 includes the on/off button 44 on the handle 32 of the housing unit 12, the power source 162 and the light 46 on the second end 16 of the housing unit 12. The on/off button 44 on the handle 32 of the housing unit 12 electrically connects the power source to the light 46 on the second end 16 of the housing unit 12 when in an "on" position. The on/off button 44 must be pressed to activate light 46 so the light 46 will not be inadvertently left on thereby draining the power source.

One form of the device can include a hose 230 connecting the pump 192 to a cylinder housing 232 in which the control valve 196 is contained and which is located inside the housing. Pressure sensor 212 can be located adjacent to the hose 230 if desired.

Operation of device 10 can be understood from the foregoing and thus will be only briefly discussed. If tire pressure is to be changed, the device 10 is attached to the tire valve via special adapter 150 and the wishbone actuator element 100 will depress the pin in the tire valve to open the inside of the tire to outside pressure. A desired pressure has been programmed into the control circuit 164 and the fluid pump 192 will be operated when the second end 112 of the first leg 108 of the wishbone actuator element 100 depresses on/off button 180. The control valve element 202 is opened by the control circuit 164 and air flows from the fluid pump 192 through the control valve 196 and through the one-way valve 210. It is noted that air from the tire cannot flow in the reverse direction due to the one-way valve 210. As soon as pressure sensed in the one-way valve 210 by pressure sensor 212 reaches a value that has been pre-set in the control circuit 164, the control circuit 164 stops the fluid pump 192 and closes the control valve element 202 to stop further air flowing into the tire. The control circuit 164 can activate lights 40 and 42 to be green when air is being added to the tire and to be red when air flow is stopped. The control circuit 164 can also be programmed to activate one or both of the lights 40 and 42 after a predetermined time of inactivity to alert the vehicle owner that it is time to check tire air pressure. Suitable displays, such as "adding air", "check tire pressure" or the like can be displayed on window 34.

It is to be understood that while certain forms of the present invention have been illustrated and described herein, it is not to be limited to the specific forms or arrangements of parts described and shown.

The invention claimed is:

1. A hand-holdable unit adapted to pump air into vehicle tires comprising:

a) a housing unit having
- (1) a first end,
- (2) a second end,
- (3) a longitudinal axis extending between the first end and the second end of said housing unit,
- (4) a first side wall,
- (5) a second side wall,
- (6) a transverse axis extending between the first side wall and the second side wall of said housing unit,
- (7) a first side surface,
- (8) a second side surface,
- (9) a thickness extending between the first side surface and the second side surface of said housing unit,
- (10) a handle on the first end of said housing unit,
- (11) a display window on the first side surface,
- (12) a plurality of control buttons on the first side surface,
- (13) a plurality of indicator lights on the first side surface,
- (14) an on/off button on the handle,
- (15) a light on the second end of said housing unit,
- (16) a hollow interior in said housing unit,
- (17) an air-dispensing opening defined through the second end of said housing unit,

(18) a first operating opening defined through the second end of said housing unit adjacent to the air-dispensing opening, and

(19) a second operating opening defined through the second end of said housing unit adjacent to the air-dispensing opening;

b) an air-dispensing nozzle unit on the second end of said housing unit and including (1) an O-ring seal located adjacent to the air-dispensing opening, (2) a front plate located adjacent to the O-ring seal, the front plate including a first actuator element leg-accommodating hole located to be adjacent to and aligned with the first operating opening defined through the second end of said housing unit and a second actuator element leg-accommodating hole located to be adjacent to and aligned with the second operating opening defined through the second end of said housing unit, (3) fasteners attaching the front plate to the second end of said housing unit, (4) a nozzle housing mounted on the front plate and having (A) a dispensing end, the dispensing end of the nozzle housing having an air-dispensing opening defined therethrough, (B) an inlet end located adjacent to and in fluid communication with the air-dispensing opening defined through the second end of said housing unit, (C) a longitudinal axis extending between the dispensing end of the nozzle housing and the inlet end of the nozzle housing and being co-linear with the longitudinal axis of said housing unit when said air-dispensing nozzle unit is in place on said housing unit, (D) an air-dispensing passage defined in the nozzle housing and fluidically connecting the air-dispensing opening in the dispensing end of the nozzle housing to the inlet end of the nozzle housing, (E) knurling grooves on said nozzle housing, and (F) a spider support frame element mounted on the nozzle housing in the air-dispensing passage adjacent to the dispensing end of the nozzle housing, the spider support frame including a hole defined therethrough and centered on the longitudinal axis of the nozzle housing, the hole defined through the spider support frame being fluidically connected to the air-dispensing passage defined in the nozzle housing, and (5) a wishbone actuator element movably located inside the nozzle housing, the wishbone actuator element having (A) a body located on the longitudinal axis of the nozzle housing and extending through the hole defined through the spider support element and located adjacent to the air-dispensing passage and adjacent to the air-dispensing opening defined in the dispensing end of the nozzle housing, the body of the wishbone actuator element including a forward end and a rear end, (B) a first leg having a first end attached to the rear end of the body of the wishbone actuator element and having a second end which extends through the first actuator element leg-accommodating hole in the front plate and through the first operating opening defined through the second end of said housing unit, (C) the wishbone actuator element moving in the nozzle housing between a first position with the forward end of the body extending out of the air-dispensing opening in the dispensing end of the nozzle housing and in a position that is adapted to engage and operate a valve opening element of a tire valve of a tire of a vehicle and a second position having the forward end of the body located adjacent to the spider support element, the second end of the first leg of the wishbone actuator element being located inside said housing unit when the wishbone actuator element is in the second position, (D) a first spring abutment on the first leg of the wishbone actuator element adjacent to the second end of the first leg, (E) a first spring on the first leg of the wishbone actuator element and having a first end abutting the first spring abutment and a second end abutting the front plate, the first spring biasing the wishbone actuator element toward the first position, (F) a second leg having a first end attached to the rear end of the body of the wishbone actuator element and having a second end which extends through the second actuator element leg-accommodating hole in the front plate and through the second operating opening defined through the second end of said housing unit, (G) a second spring abutment on the second leg of the wishbone actuator element adjacent to the second end of the second leg, and (H) a second spring on the second leg of the wishbone actuator element and having a first end abutting the second spring abutment and a second end abutting the front plate, the second spring biasing the wishbone actuator element toward the first position;

c) a tapered adapter element adapted to be accommodated through the air-dispensing opening in the dispensing end of the nozzle housing, said adapter element having a first end which is smaller than the air-dispensing opening and a second end that is larger than the air-dispensing opening and being adapted to move between a first position relative to the nozzle housing with the first end of the adapter element located inside the nozzle housing and a second position relative to the nozzle housing in which the adapter element is located outside the nozzle housing, the adapter element including a side wall connecting the first end of the adapter element to the second end of the adapter element, the side wall of the adapter element being in fluid-occluding contact with the nozzle housing adjacent to the air-dispensing opening of the nozzle housing when said adapter element is in the first position thereof, the adapter element further including an air passage fluidically connecting the first end of the adapter element to the second end of the adapter element, the air passage of said adapter element being fluidically connected to the air-dispensing passage in said nozzle unit when said adapter element is in the first position thereof, the second end of said adapter element being adapted to accommodate the valve on the tire of an automotive vehicle and to place the air passage of said adapter element in fluid communication with the inside of the tire to place the interior of the tire in fluid communication with the air-dispensing passage of said nozzle unit when said adapter element is in the first position and the wishbone actuator element is in the first position thereof;

d) an air control unit fluidically connected to the air-dispensing passage of said nozzle unit and including (1) a power source in said housing unit, (2) a control circuit in said housing unit, the control circuit including an internal memory and an internal power source, (3) a display unit in said housing unit adjacent to the display window of said housing unit, the display unit being electrically connected to the control circuit to be activated by the control circuit to indicate operations being performed by the control circuit, (4) the control buttons on said housing unit being electrically connected to the control circuit to control operations of the control circuit according to settings associated with the control buttons, (5) the indicator lights on said housing unit being electrically connected to the control unit to be activated according to operations being performed by the control circuit, (6) a push button on/off control button on the second end of said housing unit adjacent to the first actuator element leg-accommodating hole in the front plate and adjacent to the first operating opening defined through the second end of said housing unit, the push button on/off control button being located to be abuttingly engaged by the second end of the first leg of the wishbone actuator element when the wishbone actuator element is in the second position thereof, the push button on/off control button moving between an "on" condition when the second end of the first leg of the wishbone actuator element is in abutting contact with the on/off control button and an "off" condition when the second end of the first leg of the wishbone actuator element is spaced apart from the on/off control button, the on/off control button electrically connecting the power source to the control circuit when the on/off control button is in the "on" condition, (7) an air flow control fluid circuit on said housing unit and including (A) a fluid pump in said housing unit, the fluid pump being electrically connected to the control circuit to be electrically connected to the power source via the control circuit and to be activated according to control of the control circuit, the fluid pump including an air outlet located inside said housing unit, (B) a control valve including an air inlet fluidically connected to the air outlet of the fluid pump, an air outlet, a control valve element that moves between a fluid passage position fluidically connecting the air outlet of the control valve to the air inlet of the control valve and a fluid-occluding position in which the control valve element is in a position preventing fluid communication between the air inlet of the control valve and the air outlet of the fluid control valve, the control valve further including a spring element which biases the control valve element towards the fluid-occluding position and a control valve element moving unit electrically connected to the control circuit to be controlled thereby and connected to the control valve element to move the control valve element against the bias of the spring element into the fluid passage position when activated by the control circuit, and (C) a one-way valve fluidically interposed between the control valve and the air-dispensing passage of said nozzle unit and positioned to prevent fluid flow from the air-dispensing passage of said nozzle unit towards the control valve and to permit fluid flow from the control valve towards the air-dispensing passage of said nozzle unit, the one-way valve including a pressure sensor which is electrically connected to the control circuit to activate the control circuit to stop operation of the fluid pump when fluid pressure in the one-way valve reaches a pressure level that has been set using one of the control buttons; and e) a light circuit which includes the on/off button on the handle of said housing unit, the power source and the light on the second end of said housing unit, the on/off button on the handle of said housing unit electrically connecting the power source to the light on the second end of said housing unit when in an "on" position.

2. The unit as described in claim 1 wherein said power source includes a rechargeable battery, and said housing unit further includes battery recharging contacts thereon.

3. The unit as described in claim 1 wherein the control circuit includes a memory circuit which activates one of the indicator lights after a pre-set time period, even when the power source is not electrically connected to the control circuit.

4. The unit as described in claim 1 further including a hose fluidically connected to the fluid pump.

5. The unit as described in claim 4 further including an air chamber fluidically connected to the hose.

6. The device as described in claim 1 wherein the control circuit includes a reminder circuit.

7. A hand-holdable unit adapted to pump air into a tire of a vehicle comprising:

a) a housing unit having a handle and an air-dispensing opening defined therein;

b) an air-dispensing nozzle unit on said housing unit including (1) a front plate on said housing unit, (2) a nozzle housing mounted on the front plate and having an inlet end in fluid communication with the air-dispensing opening on said housing unit and an outlet end in fluid communication with the inlet end of the nozzle housing, (3) a wishbone actuator element in said nozzle unit and movable between a first position and a second position and including (A) a body which is located adjacent to the outlet end of the nozzle housing, (B) a first leg connected to the body and extending into said housing unit, (C) a second leg connected to the body, and (D) a spring element mounted on the wishbone actuator element in a manner which biases the wishbone actuator element toward the first position;

c) an adapter element which is sized and adapted to be received in said nozzle unit adjacent to the outlet end of said nozzle unit and which is adapted to be in fluid communication with a valve on a tire of a vehicle;

d) an air control unit which includes (1) a power source in said housing unit, (2) a control circuit in said housing unit and which includes an internal memory and an internal power supply, (3) a push button on/off control button on said housing unit and positioned to be engaged by the first leg of the wishbone actuator element when the wishbone actuator element is in the second position, the push button on/off control button electrically connecting the control circuit to the power source when the push button on/off control button is in an "on" condition, the push button on/off control button being placed in the "on" condition when engaged by the first leg of the wishbone actuator element, and (4) an air flow control circuit on said housing unit and which includes (A) a fluid pump electrically connected to the control circuit to be activated by the control circuit, (B) a control valve that is electrically connected to the control circuit and which moves between a fluid flow position and a fluid-blocking position and which includes a biasing element biasing the control valve toward the fluid blocking position, the control valve further including an element that is electrically connected to the control circuit and which moves the control valve against the bias of the biasing element toward the fluid flow position when activated by the control circuit when the control circuit is connected to the power source by the push button on/off control button, (C) a one-way valve fluidically interposed between the control valve and the outlet end of the nozzle housing and oriented to permit fluid flow toward the outlet end of the nozzle housing and to prevent fluid flow from the outlet end of the nozzle housing toward the control valve, (D) a pressure sensor in the one-way valve and electrically connected to the control circuit to activate the control circuit to disconnect the pump from the power source when a pre-set pressure is sensed in the one-way valve by the pressure sensor, and (E) the fluid connection between the one-way valve and the control valve and the pump and the outlet end of the nozzle housing permitting flow of fluid from the fluid pump to the outlet end of the nozzle housing and via the outlet end of the nozzle housing to a tire valve of a vehicle tire and via the tire valve to the tire when the fluid pump is actuated by the wishbone actuator via the control circuit when fluid pressure in the one-way valve is below the pre-set pressure; and e) a light circuit on said housing unit, said light circuit including a light on said housing unit and a switch on the handle which electrically connects the light on said housing unit to the power source when the switch on the handle is in an "on" position.

* * * * *